US007644828B1

(12) United States Patent
Klein

(10) Patent No.: US 7,644,828 B1
(45) Date of Patent: Jan. 12, 2010

(54) BOTTLE/CONTAINER COUPLING SYSTEM

(76) Inventor: Steven Klein, 6618 Peach Tree Creek Rd., Bradenton, FL (US) 34203

( * ) Notice: Subject to any disclaimer, the term of this patent is extended or adjusted under 35 U.S.C. 154(b) by 370 days.

(21) Appl. No.: 11/786,124

(22) Filed: Apr. 11, 2007

(51) Int. Cl.
*B65D 21/02* (2006.01)
*A63H 33/04* (2006.01)

(52) U.S. Cl. ..... 215/10; 206/509; 220/23.4; 220/23.6; 446/117; 446/121

(58) Field of Classification Search ..... 215/10; 220/23.4, 23.6, 23, 83; 482/105; 446/71, 446/74, 117, 121; 206/509
See application file for complete search history.

(56) References Cited

U.S. PATENT DOCUMENTS

| | | | | | |
|---|---|---|---|---|---|
| 769,615 | A * | 9/1904 | Kosansvich | 215/10 |
| 2,773,521 | A * | 12/1956 | Persson | 141/5 |
| 3,374,917 | A * | 3/1968 | Troy | 220/23.4 |
| 3,587,847 | A | 6/1971 | Graser | |
| 3,815,281 | A * | 6/1974 | Kander | 446/77 |
| 4,076,236 | A | 2/1978 | Ionel | |
| 4,624,383 | A * | 11/1986 | Moore | 220/23.4 |
| 5,135,823 | A * | 8/1992 | Eales | 429/156 |
| D337,522 | S | 7/1993 | Kingsbury | |
| 5,314,067 | A * | 5/1994 | Strock | 206/430 |
| 5,441,471 | A * | 8/1995 | Passer | 482/106 |
| 5,480,028 | A | 1/1996 | Robinson | |
| 6,276,549 | B1 * | 8/2001 | Fasci et al. | 220/23.4 |
| D465,151 | S * | 11/2002 | Mixon | D9/668 |
| 7,175,498 | B2 * | 2/2007 | Garpow et al. | 446/117 |
| 2005/0189243 | A1 * | 9/2005 | Manabe et al. | 206/139 |
| 2006/0030234 | A1 | 2/2006 | Stiber et al. | |
| 2009/0045157 | A1 * | 2/2009 | Panchal et al. | 215/10 |

FOREIGN PATENT DOCUMENTS

| | | | |
|---|---|---|---|
| JP | 2003192044 | A | 7/2003 |

* cited by examiner

*Primary Examiner*—Sue A Weaver
(74) *Attorney, Agent, or Firm*—Edward P Dutkiewicz

(57) ABSTRACT

A container has an open top end and a closed bottom end. A chamber is provided between the top and bottom ends. The top end is formed as a neck. The bottom end is formed as a recess. The neck and recess are essentially cylindrical. The neck and recess have a common axis and an essentially common length and diameter. The recess is adapted to receive a neck of another similarly configured bottle/container system. The neck is adapted to be coupled to a recess of another similarly configured bottle/container system.

9 Claims, 7 Drawing Sheets

FIG 1
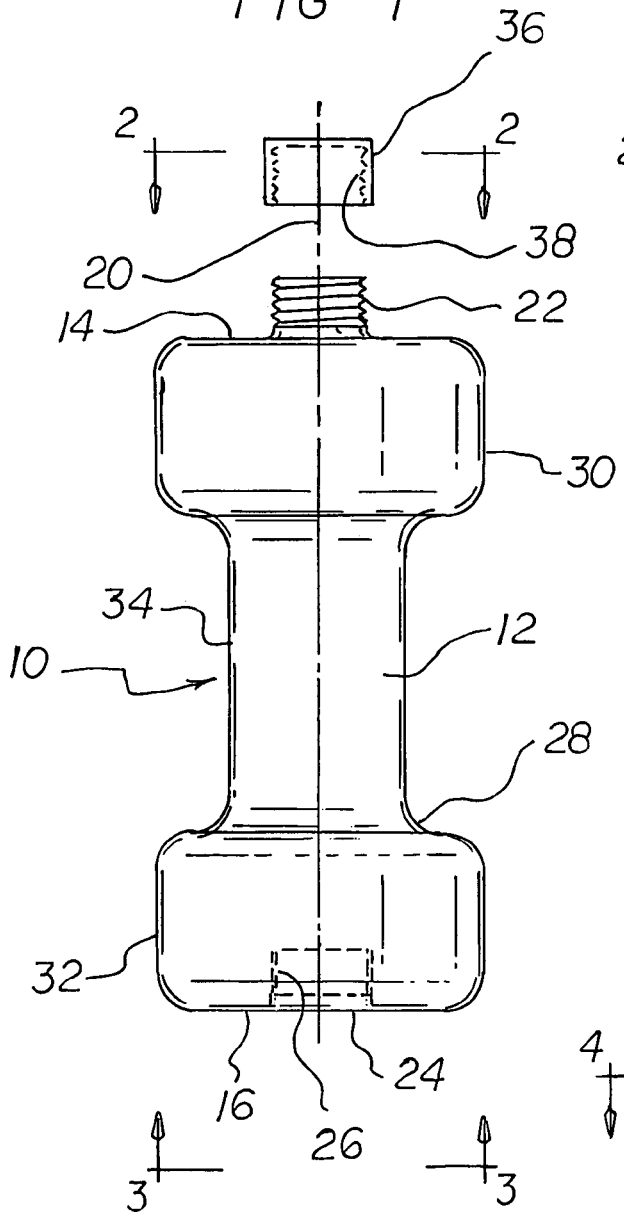
FIG 2
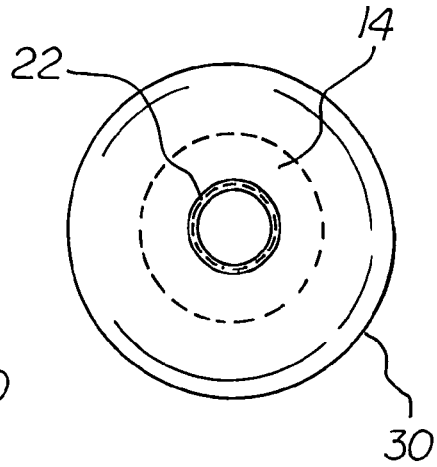
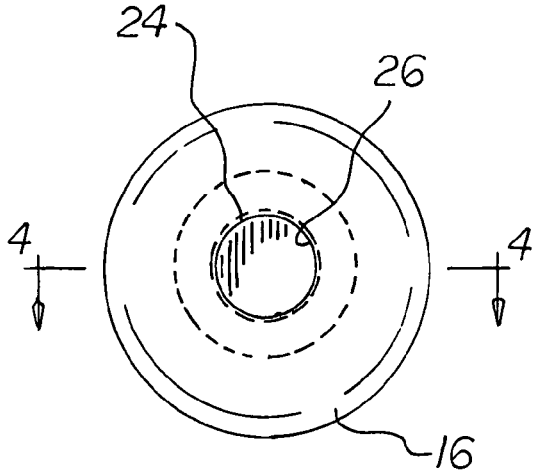
FIG 3

FIG 11A
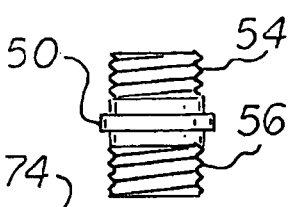
FIG 11B
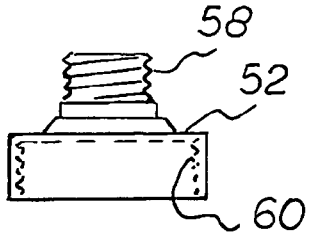
FIG 11E
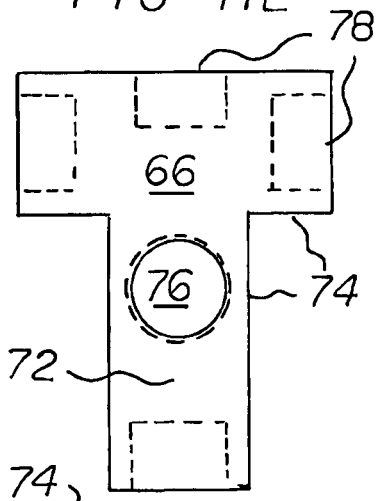
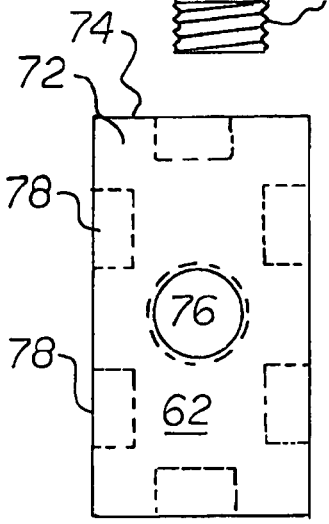
FIG 11C
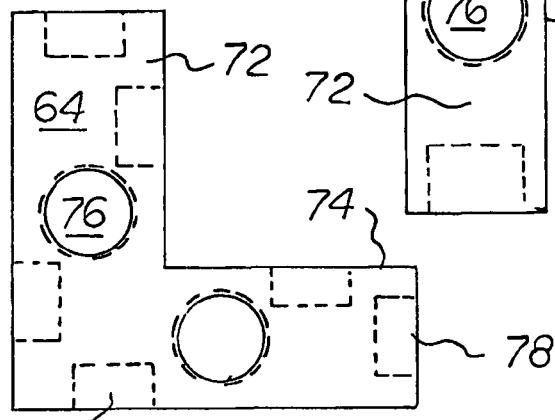
FIG 11D
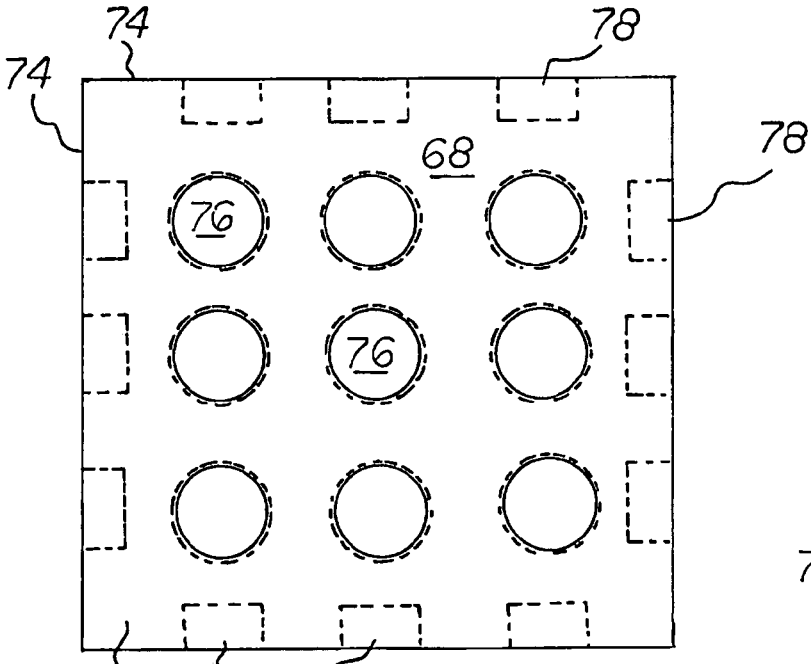
FIG 11F
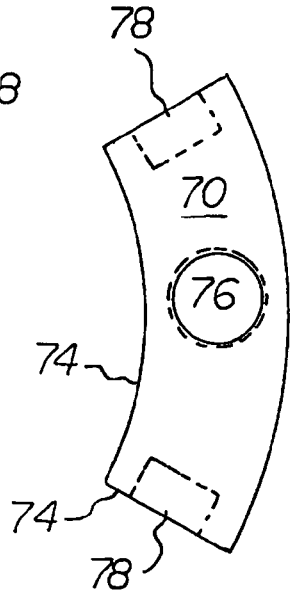
FIG 11G FIG 12
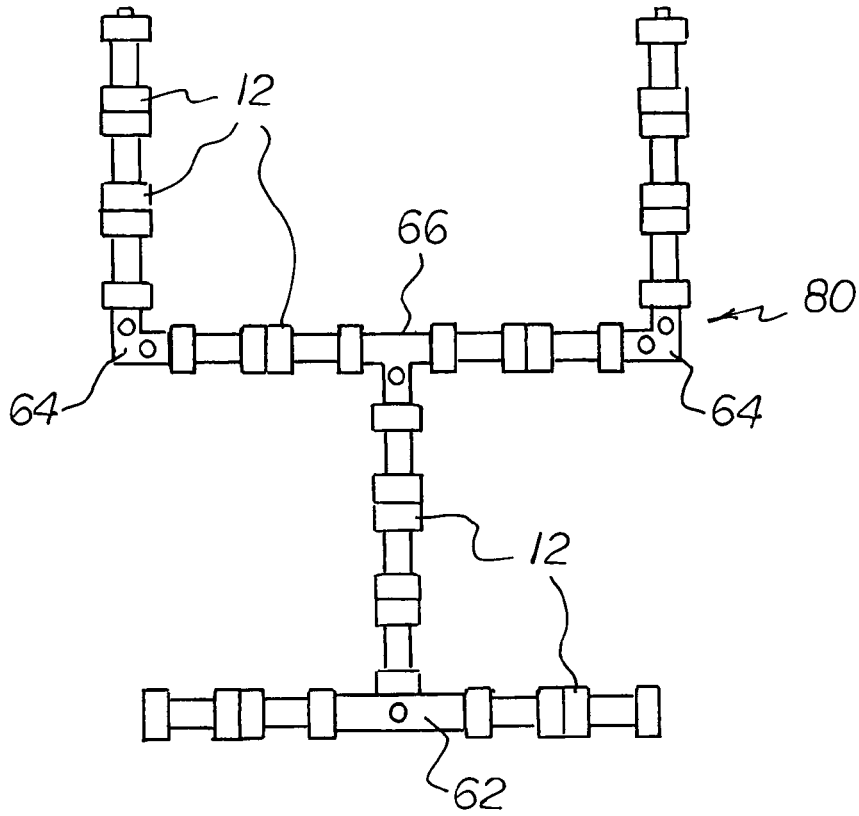
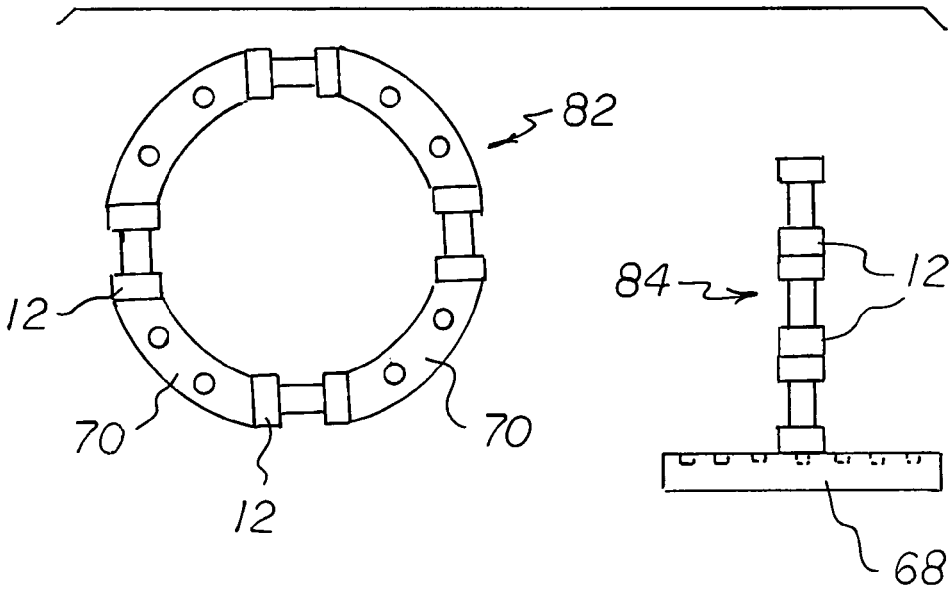
FIG 13

BOTTLE/CONTAINER COUPLING SYSTEM

BACKGROUND OF THE INVENTION

1. Field of the Invention

The present invention relates to a bottle/container coupling system, herein referred to as a bottle/container system, and more particularly pertains to coupling bottles and containers in a convenient and utilitarian manner.

2. Description of the Prior Art

The use of containers of known designs and configurations is known in the prior art. More specifically, containers and couplers of known designs and configurations previously devised and utilized for the purpose of storing liquids and other substances through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,587,847 issued Jun. 28, 1971 to Graser relates to a Single-Ply Crown Support Carrier. U.S. Pat. No. 4,076,236 issued Feb. 28, 1978 to Ionel relates to a Bar-Bell Type Exercising Device. U.S. Pat. No. 5,480,028 issued Jan. 2, 1986 to Robinson relates to a Stackable Plastic Container Package. Lastly, U.S. Pat. No. Des. 337,522 issued Jul. 20, 1993 to Kingsbury relates to a Combined Bottle and Cap.

While these devices fulfill their respective, particular objectives and requirements, the aforementioned patents do not describe a bottle/container system that allows coupling bottles and containers in a convenient and utilitarian manner.

In this respect, the bottle/container system according to the present invention substantially departs from the conventional concepts and designs of the prior art, and in doing so provides an apparatus primarily developed for the purpose of coupling bottles and containers in a convenient and utilitarian manner.

Therefore, it can be appreciated that there exists a continuing need for a new and improved bottle/container system which can be used for coupling bottles and containers in a convenient and utilitarian manner. In this regard, the present invention substantially fulfills this need.

SUMMARY OF THE INVENTION

In view of the foregoing disadvantages inherent in the known types of containers of known designs and configurations now present in the prior art, the present invention provides an improved bottle/container system. As such, the general purpose of the present invention, which will be described subsequently in greater detail, is to provide a new and improved bottle/container system and method which has all the advantages of the prior art and none of the disadvantages.

To attain this, the present invention essentially comprises a bottle/container system. First provided is a bottle. The bottle has an open top end. The bottle has a closed bottom end. The bottle has a chamber. The chamber is provided between the open top end and the closed bottom end. The chamber has a generally cylindrical configuration. The chamber has a cental axis. The central axis extends through the top and bottom ends and the chamber. The top end is formed as a neck. The neck has a short axial length and a generally common diameter along its length. The neck has external male threads. The bottom end formed as a recess. The recess has a short axial length. The length of the recess is generally equal to the length of the neck. The recess has a common diameter along its length. The diameter of the recess is generally equal to the diameter of the neck. The recess has internal female threads. The neck and recess are essentially cylindrical in configuration. The neck and recess have a common axis. The common axis of the neck and recess is coextensive with the axis of the chamber.

The chamber is encompassed by the top and bottom ends. The chamber has a side wall. The chamber has top and bottom sections. The chamber has a central section. The central section is provided between the top and bottom sections. The top and bottom and central sections are generally cylindrical with an axis. The axis is common with the axis of the chamber and neck and recess. The top and bottom sections each have a common axial length. The length of the top and bottom sections is less than the axial length of the central section. The top and bottom sections each have a common diameter. The diameter is greater than the diameter of the central section. In this manner the appearance of a dumbbell is provided. The bottle is adapted to function as a container for holding a quantity of liquid and other substances in the chamber and for dispensing though the neck. The system is fabricated of polyethylene terephthalate in the preferred embodiment. Other suitable materials are adapted to be utilized.

Further provided is a cap. The cap has internal female threads. The cap is adapted to be threadably coupled to the male threads of the neck. In this manner a liquid and other substances is retained within the chamber. The recess is adapted to receive a neck of another similarly configured bottle/container system. The neck is adapted to be coupled to a recess of another similarly configured bottle/container system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bottle/container system which has all of the advantages of the prior art containers of known designs and configurations and none of the disadvantages.

It is another object of the present invention to provide a new and improved bottle/container system which may be easily and efficiently manufactured and marketed.

It is further object of the present invention to provide a new and improved bottle/container system which is of durable and reliable constructions.

An even further object of the present invention is to provide a new and improved bottle/container system which is susceptible of a low cost of manufacture with regard to both materials and labor, and which accordingly is then susceptible of low prices of sale to the consuming public, thereby making such bottle/container system economically available to the buying public.

Even still another object of the present invention is to provide a bottle/container system for coupling bottles and containers in a convenient and utilitarian manner.

Lastly, it is an object of the present invention to provide a new and improved bottle/container system. A container has an open top end and a closed bottom end. A chamber is provided between the top and bottom ends. The top end is formed as a neck. The bottom end is formed as a recess. The neck and recess are essentially cylindrical. The neck and recess have a common axis and an essentially common length and diameter. The recess is adapted to receive a neck of another similarly configured bottle/container system. The neck is adapted to be coupled to a recess of another similarly configured bottle/container system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a bottle/container system constructed in accordance with the principles of the present invention.

FIG. 2 is a plan view of the system taken along line 2-2 of FIG. 1.

FIG. 3 is a bottom view of the system taken along line 3-3 of FIG. 1.

FIGS. 11A and 11B are front elevational views of cylindrical supplemental couplers for use in association with bottle/container systems illustrated in the prior Figures.

FIGS. 11C through 11G are plan views of planar supplemental couplers for use in association with bottle/container systems illustrated in the prior Figures.

FIG. 12 is an illustration of a plurality of bottle/container systems and supplemental couplers shown in the prior Figures removably coupled with respect to each other for forming a goal post.

FIG. 13 is an illustration of a plurality of bottle/container systems and supplemental couplers shown in the prior Figures removably coupled with respect to each other for forming a ring and goal game.

The same reference numerals refer to the same parts throughout the various Figures.

DESCRIPTION OF THE PREFERRED EMBODIMENT

Figure 4:
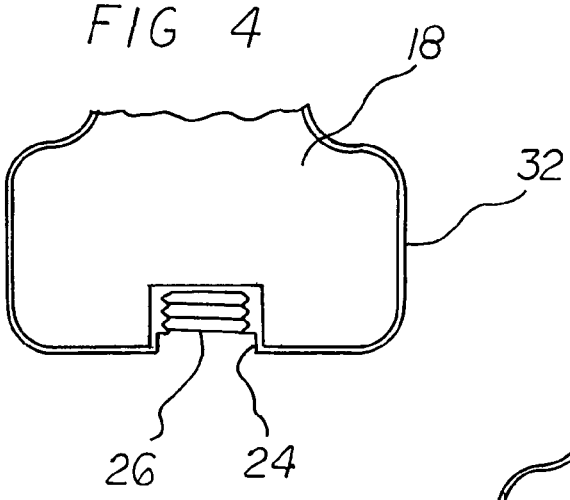
FIG. 4 is a cross sectional view of the system taken along line 4-4 of FIG. 1.

With reference now to the drawings, and in particular to FIG. 1 thereof, the preferred embodiment of the new and improved bottle/container system embodying the principles and concepts of the present invention and generally designated by the reference numeral 10 will be described.

The present invention, the bottle/container system 10 is comprised of a container such as a bottle for liquids and other substances.

First provided is a bottle 12. The bottle has an open top end 14. The bottle has a closed bottom end 16. The bottle has a chamber 18. The chamber is provided between the open top end and the closed bottom end. The chamber has a generally cylindrical configuration. The chamber has a cental axis 20. The central axis extends through the top and bottom ends and the chamber. The top end is formed as a neck. The neck has a short axial length and a generally common diameter along its length. The neck has external male threads 22. The bottom end formed as a recess 24. The recess has a short axial length. The length of the recess is generally equal to the length of the neck. The recess has a common diameter along its length. The diameter of the recess is generally equal to the diameter of the neck. The recess has internal female threads 26. The neck and recess are essentially cylindrical in configuration. The neck and recess have a common axis. The common axis of the neck and recess is coextensive with the axis of the chamber.

The chamber is encompassed by the top and bottom ends. The chamber has a side wall 28. The chamber has top and bottom sections 30, 32. The chamber has a central section 34. The central section is provided between the top and bottom sections. The top and bottom and central sections are generally cylindrical with an axis. The axis is common with the axis of the chamber and neck and recess. The top and bottom sections each have a common axial length. The length of the top and bottom sections is less than the axial length of the central section. The top and bottom sections each have a common diameter. The diameter is greater than the diameter of the central section. In this manner the appearance of a dumbbell is provided. The bottle is adapted to function as a container for holding a quantity of liquid and other substances in the chamber and for dispensing though the neck. The system is, in the preferred embodiment, fabricated of polyethylene terephthalate.

Figure 8:
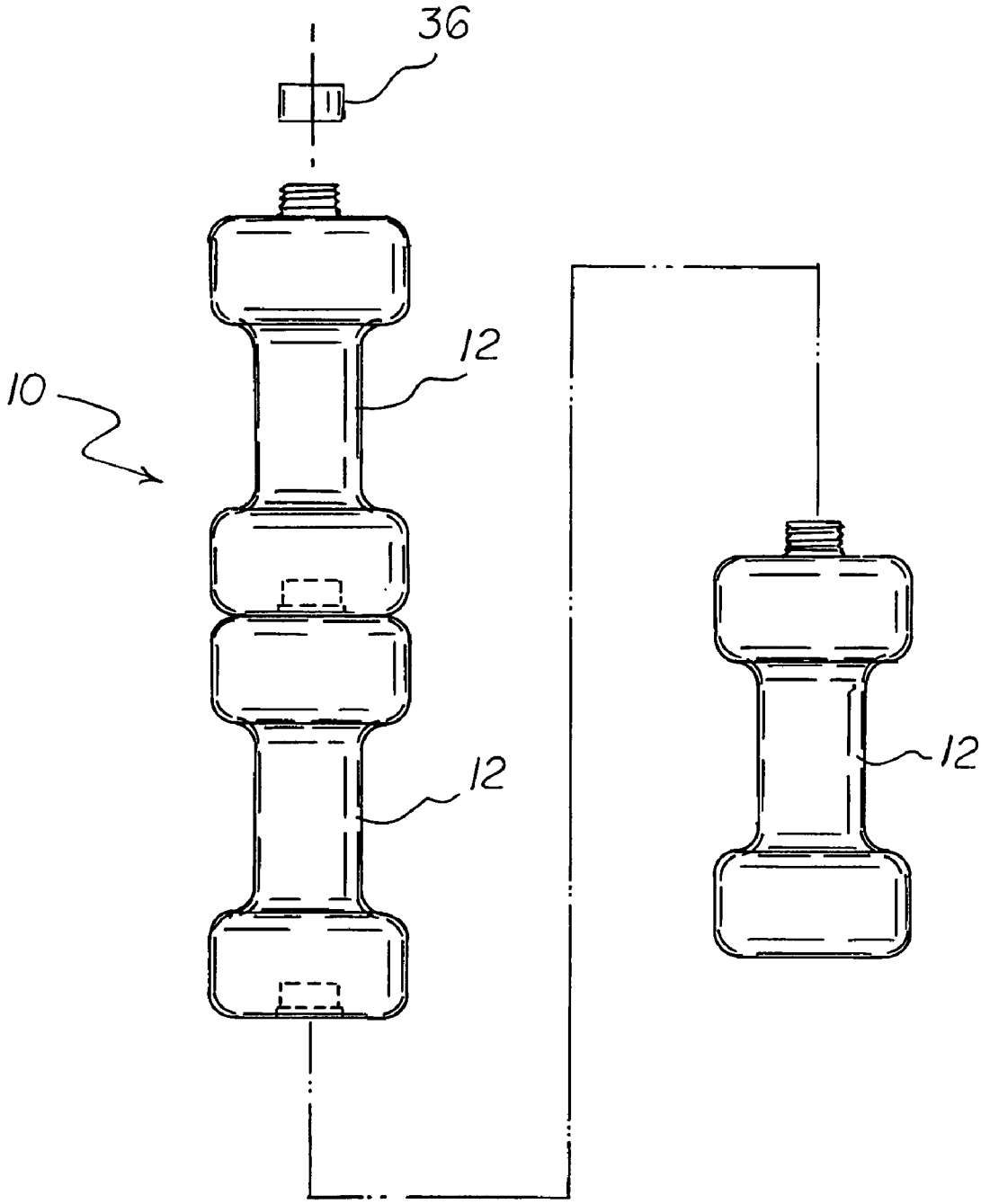
FIG. 8 is an exploded illustration of a plurality of bottle/container systems removably coupled with respect to each other.

Further provided is a cap 36. The cap has internal female threads 38. The cap is adapted to be threadably coupled to the male threads of the neck. In this manner a liquid and other substances is retained within the chamber. Note FIGS. 1 and 8. The recess is adapted to receive a neck of another similarly configured bottle/container system. The neck is adapted to be coupled to a recess of another similarly configured bottle/container system.

Figure 5:
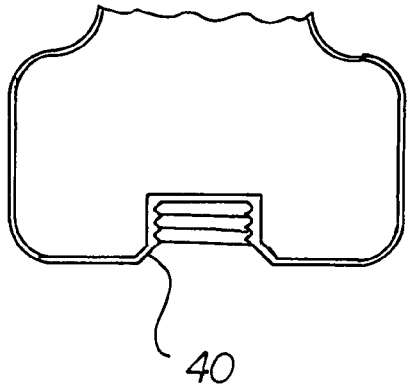
FIGS. 5, 6 and 7 are cross sectional views similar to FIG. 4 but illustrating alternate embodiments of the invention.

The first alternate embodiment of the present invention is illustrated in FIG. 5. The system includes external male threads on the neck. The recess is threaded with a tapering end 40 on the recess.

Figure 6:
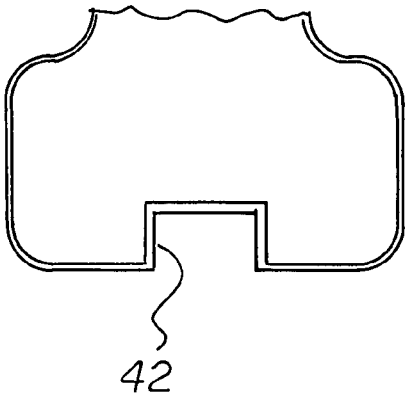

The second alternate embodiment of the present invention is illustrated in FIG. 6. The system includes external male threads on the neck. The recess 42 is unthreaded.

Figure 7:
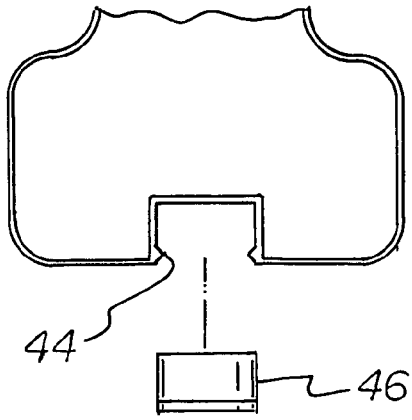

The third alternate embodiment of the present invention is illustrated in FIG. 7. The system includes external male threads on the neck. The recess is unthreaded. An annular ring 44 is provided at the end of the recess. A cap 46 is provided. In this manner the cap may be releasably supported.

Figure 9:
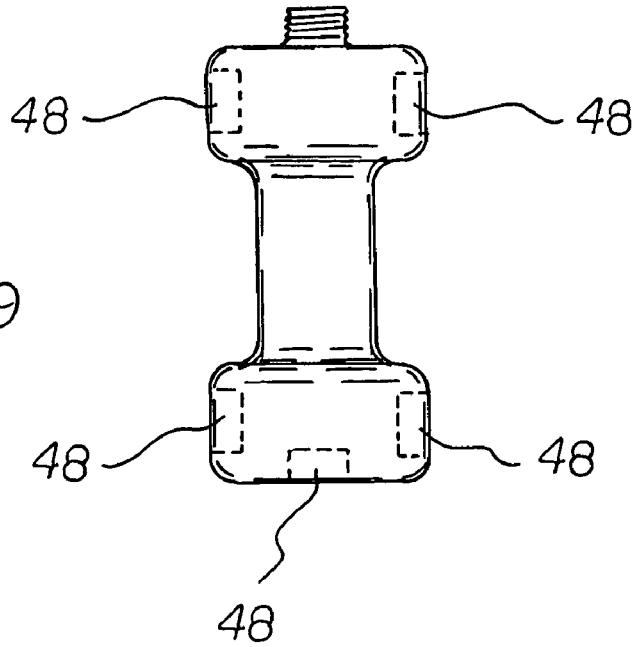
FIG. 9 is a front elevational view of another alternate embodiment of the invention.
Figure 10:
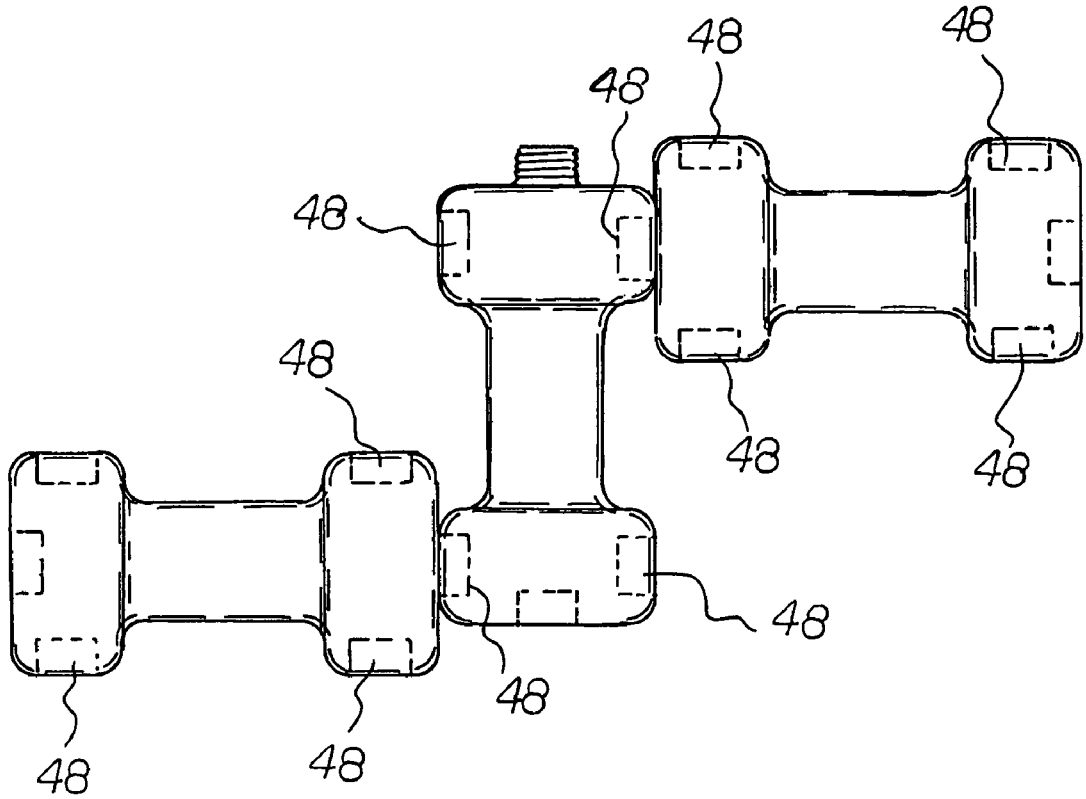
FIG. 10 is an illustration of a plurality of bottle/container systems shown in FIG. 9 removably coupled with respect to each other.

The fourth embodiment of the present invention is illustrated in FIGS. 9 and 10. The system includes external male threads on the neck. The system includes internal female threads in the recess. Supplemental recesses 48 are provided. The supplemental recesses are adapted to receive necks of other similarly configured container systems. The neck is adapted to be coupled to a supplemental recess of another similarly configured container system.

Additional alternate embodiments of the present invention are illustrated in FIGS. 11A and 11B. The system includes external male threads on the neck. The system includes internal female threads in the recess. The system further includes a supplemental coupler 50, 52. The coupler is adapted to releasably couple a plurality of container systems.

In FIG. 11A, a supplemental coupler 50 is provided. The supplemental coupler is cylindrical. The supplemental coupler has two ends. The supplemental coupler has external male threads 54 on one end and external male threads 56 on the other end.

In FIG. 11B, a supplemental coupler 52 is provided. The supplemental coupler is cylindrical. The supplemental coupler has two ends. The supplemental coupler has external male threads 58 on one end and internal female threads 60 on the other end.

With reference to FIG. 11B, the supplemental coupler 52 is cylindrical. The supplemental coupler has two ends. The supplemental coupler has threads on both ends. The threads are of different diameters. In this manner coupling of containers of different sizes is allowed.

In FIGS. 11C through 11G, supplemental couplers 62, 64, 66, 68, 70 are provided. The supplemental couplers are generally planar in configuration. Each planar supplemental coupler has a face 72 and a periphery 74. Each supplemental coupler has at least one threaded aperture 76 through the face. Each supplemental coupler has at least one threaded recess 78 in the periphery.

In FIG. 11C, a supplemental coupler 62 is provided. The supplemental coupler is I-shaped.

In FIG. 11D, a supplemental coupler 64 is provided. The supplemental coupler is L-shaped.

In FIG. 11E, a supplemental coupler 66 is provided. The supplemental coupler is T-shaped.

In FIG. 11F, a supplemental coupler 68 is provided. The supplemental coupler is square-shaped.

In FIG. 11G, a supplemental coupler 70 is provided. The supplemental coupler is curved-shaped.

Ah alternate embodiment of the present invention is illustrated in FIG. 12. The system includes a plurality of container systems and a plurality of supplemental couplers. The container systems and supplemental couplers are releasably coupled in the shape of a goal post 80.

The next alternate embodiment of the present invention is illustrated in FIG. 13. The system includes a plurality of container systems and a plurality of supplemental couplers. The container systems and supplemental couplers are releasably coupled in the shape of a ring 82 and a goal 84.

Figure 14:
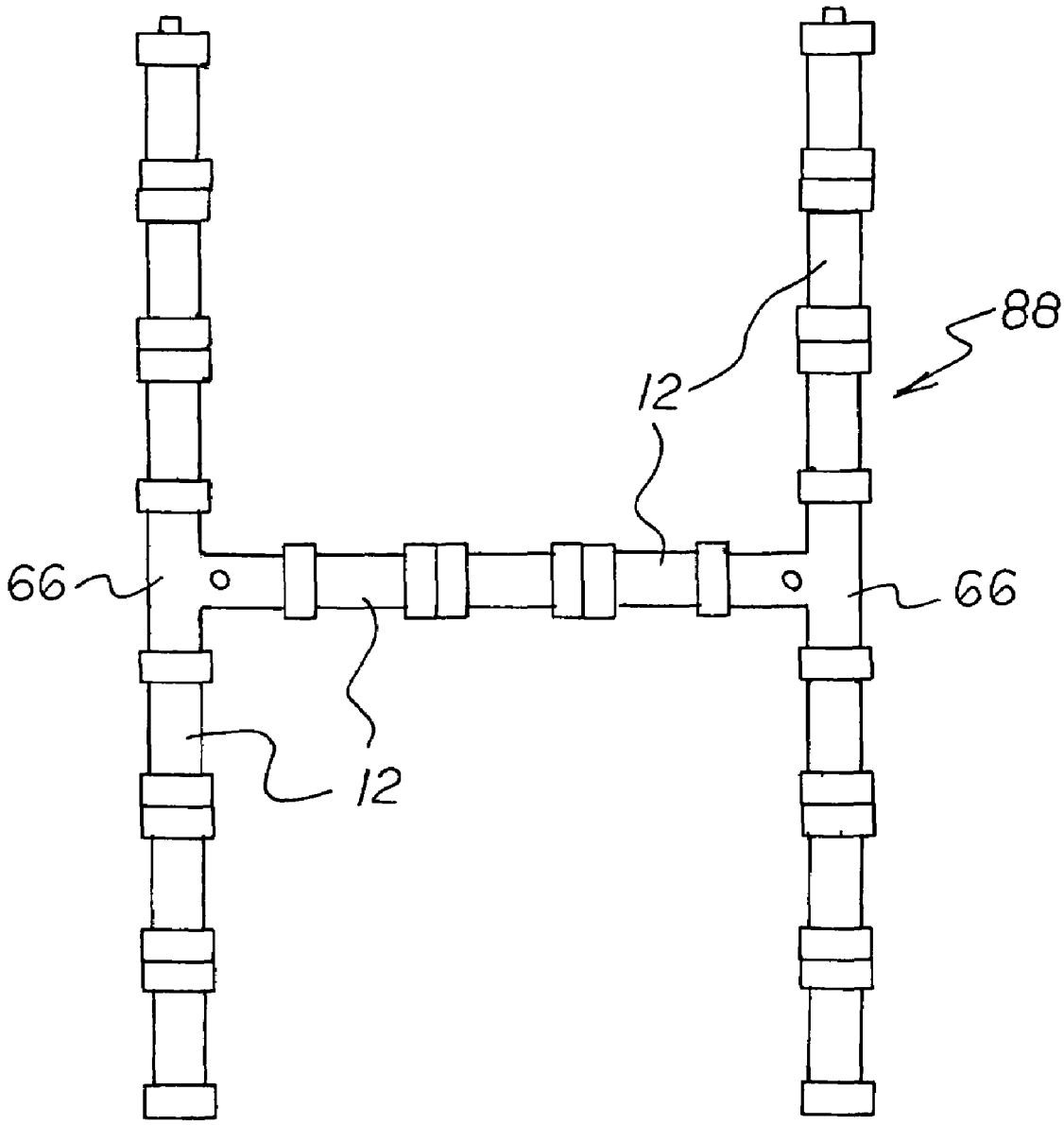
FIG. 14 is an illustration of a plurality of bottle/container systems and supplemental couplers shown in the prior Figures removably coupled with respect to each other for forming a letter of the alphabet.

FIG. 14 is an illustration of the final alternate embodiment of the invention. In such embodiment a plurality of bottle/container systems and supplemental couplers are utilized. As in the prior Figures, the components are removably coupled with respect to each other. The coupling is in the form of a letter 88 of the alphabet. Other letters could be readily formed. In this manner, educational capabilities are provided.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container coupling system comprising:

a container having an open top end and a closed bottom end with a chamber there between, the top end formed as a neck and with the bottom end formed as a recess, the neck and recess being essentially cylindrical with a common axis and with an essentially common length and diameter, the recess adapted to receive a neck of another similarly configured bottle/container system, the neck adapted to be coupled to a recess of another similarly configured bottle/container system;

external male threads on the neck and internal female threads in the recess and further including a supplemental coupler adapted to releasably couple a plurality of container systems; and the supplemental coupler being generally planar in configuration having a face and a periphery and with at least one threaded aperture through the face and at least one threaded recess in the periphery.

2. The system as set forth in claim 1 wherein the supplemental coupler is I-shaped.

3. The system as set forth in claim 1 wherein the supplemental coupler is L-shaped.

4. The system as set forth in claim 1 wherein the supplemental coupler is T-shaped.

5. The system as set forth in claim 1 wherein the supplemental coupler is square-shaped.

6. The system as set forth in claim 1 wherein the supplemental coupler is curved-shaped.

7. The system as set forth in claim 1 and further including a plurality of container systems and a plurality of supplemental couplers releasably coupled in the shape of a goal post.

8. The system as set forth in claim 1 and further including a plurality of container systems and a plurality of supplemental couplers releasably coupled in the shape of a ring and a goal.

9. The system as set forth in claim 1 and further including a plurality of container systems and a plurality of supplemental couplers releasably coupled in the shape of a letter of the alphabet.

* * * * *